US010295176B1

(12) United States Patent
Corkwell

(10) Patent No.: US 10,295,176 B1
(45) Date of Patent: May 21, 2019

(54) SELF-EXTINGUISHING CANDLE WICK SAFETY SYSTEM

(71) Applicant: Helen N. Corkwell, Fair Oaks Ranch, TX (US)

(72) Inventor: Helen N. Corkwell, Fair Oaks Ranch, TX (US)

( * ) Notice: Subject to any disclaimer, the term of this patent is extended or adjusted under 35 U.S.C. 154(b) by 238 days.

(21) Appl. No.: 15/475,662

(22) Filed: Mar. 31, 2017

Related U.S. Application Data

(60) Provisional application No. 62/318,331, filed on Apr. 5, 2016.

(51) Int. Cl.
*F23D 3/16* (2006.01)
*F23N 1/00* (2006.01)
*F23N 5/00* (2006.01)

(52) U.S. Cl.
CPC ..... *F23D 3/16* (2013.01); *F23D 2209/00* (2013.01); *F23N 1/00* (2013.01); *F23N 5/00* (2013.01)

(58) Field of Classification Search
CPC ..... F23D 3/16; F23N 1/00; F23N 5/00
USPC ..... 431/291; 362/161
See application file for complete search history.

(56) References Cited

U.S. PATENT DOCUMENTS 4,333,548 A * 6/1982 Jones ..... F03G 7/10 185/33
4,624,633 A * 11/1986 Bandel ..... C10L 1/02 126/265
5,961,318 A * 10/1999 Chambers ..... F23D 3/26 431/291
6,062,847 A * 5/2000 Pappas ..... F21V 35/00 431/291
6,129,771 A * 10/2000 Ficke ..... A61L 9/012 431/126
6,398,544 B2 * 6/2002 Wright ..... F23D 3/16 431/289
6,960,076 B2 * 11/2005 Yu ..... F21S 6/001 431/253
7,086,752 B1 * 8/2006 Feuer ..... C11C 5/00 362/161
7,293,984 B2 * 11/2007 Ortiz, Jr. ..... F23D 3/16 431/289
7,607,915 B2 * 10/2009 Adair ..... A61L 9/037 431/289
8,206,150 B2 * 6/2012 Wade ..... F23D 3/18 431/288
2004/0033463 A1 * 2/2004 Pesu ..... F23D 3/08 431/289

(Continued)

*Primary Examiner* — Gregory L Huson
*Assistant Examiner* — Nikhil P Mashruwala
(74) *Attorney, Agent, or Firm* — Plager Schack LLP; Mark H. Plager; Kara Verryt

(57) ABSTRACT

A self-extinguishing wick system may include a wax base having a base wick orifice; and a wick threaded through the base wick orifice and secured to prevent the wick from unintentionally sliding through the base wick orifice. The wick may be secured using a knot. Alternatively, the wick system may also include a first wax disc having a disc wick orifice, wherein the first wax disc is positioned adjacent to the bottom of the wax base, and the wick extends through both the wax base and the first wax disc; and a second wax disc positioned adjacent to the bottom of the first wax disc such that an end of the wick is sandwiched between the first wax disc and the second wax disc. The melting point of the wick system may be higher than that of the candle wax.

8 Claims, 4 Drawing Sheets

(56) References Cited

U.S. PATENT DOCUMENTS

| | | | | |
|---|---|---|---|---|
| 2005/0227190 | A1* | 10/2005 | Pappas | F23D 3/26 431/35 |
| 2007/0048684 | A1* | 3/2007 | Cole | C11C 5/008 431/291 |
| 2009/0233249 | A1* | 9/2009 | Taylor | F23D 3/16 431/35 |
| 2011/0076631 | A1* | 3/2011 | Wodraska | C11C 5/006 431/289 |

* cited by examiner

SELF-EXTINGUISHING CANDLE WICK SAFETY SYSTEM

RELATED APPLICATION

This application claims priority to provisional patent application U.S. Ser. No. 62/318,331 filed on Apr. 5, 2016 entire contents of which is herein incorporated by reference.

BACKGROUND

The embodiments herein relate generally to candles, and more particularly, to a self-extinguishing candle wick safety system including a wax disc that melts and releases a candle's wick, causing the wick to extinguish in the melt pool.

Global candle standards (currently available as ASTM F2417-16) recommend that at least ½ inch of wax remain in the container to prevent house fires. Most consumers ignore, or forget, this recommendation. Conventional container candles use a wick attached to a metal disc, wherein the metal disc may be adhered to the bottom of the container. As a result, the metal disc stays in place as the candle burns. However, when the candle has burned down, particularly to levels below the global candle standards recommendations, the conventional wick system poses a fire hazard, because it will continue to burn even after the candle wax has melted.

Moreover, a user may be able to see the metal disc on the bottom of the candle, which may be considered unsightly.

Therefore, what is needed is a system that will automatically extinguish the wick when the candle wax has melted down, wherein the system is also visually pleasing.

SUMMARY

Some embodiments of the present disclosure include a self-extinguishing wick system for a container candle. The self-extinguishing wick system may include a wax base having a base wick orifice; and a wick threaded through the base wick orifice and secured to prevent the wick from unintentionally sliding through the base wick orifice. The wick may be secured using a knot. Alternatively, the wick system may also include a first wax disc having a disc wick orifice, wherein the first wax disc is positioned adjacent to a bottom surface of the wax base such that the disc wick orifice aligns with the base wick orifice, and the wick extends through both the wax base and the first wax disc; and a second wax disc positioned adjacent to a bottom surface of the first wax disc such that an end of the wick is sandwiched between the first wax disc and the second wax disc. The melting point of the wick system may be higher than that of the candle wax.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to support a wick in a container candle and cause the candle to self-extinguish and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Wax Base
2. Pair of Wax Discs
3. Wick

The various elements of the device of the present disclosure may be related in the following exemplary fashion. It is not intended to limit the scope or nature of the relationships between the various elements and the following examples are presented as illustrative examples only.

By way of example, and referring to FIGS. 1-10, some embodiments of the present disclosure include a self-extinguishing wick system for a container candle, the wick system comprising a wax base 10 having a base wick orifice 18 extending therethrough; and a wick 12 threaded through the base wick orifice 18.

In some embodiments, the wick 12 comprises a knot (not shown) at a first end thereof, wherein the knot has a diameter larger than a diameter of the base wick orifice 18 in the wax base 10 such that the knot prevents the wick 12 from sliding completely through the wax base 10. In embodiments, a bottom surface of wax base 10 may comprise a bottom indentation 22 such that, when the wick 12 is threaded through the base wick orifice 18, the knot may be situated within the indentation 22 such that the wick system may sit on a level surface without tipping over. Thus, the wick system of the present disclosure may not include a metal disk or any adhesive.

Figure 1:
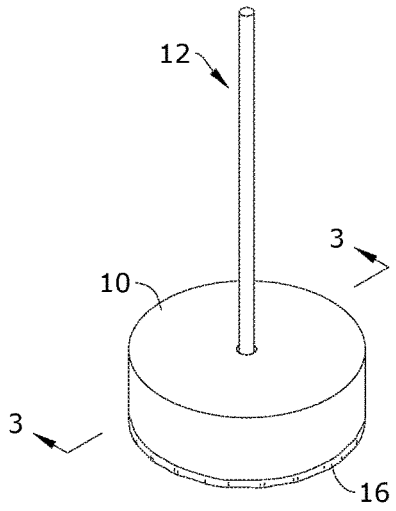
FIG. 1 is a perspective view of one embodiment of the present disclosure.
Figure 2:
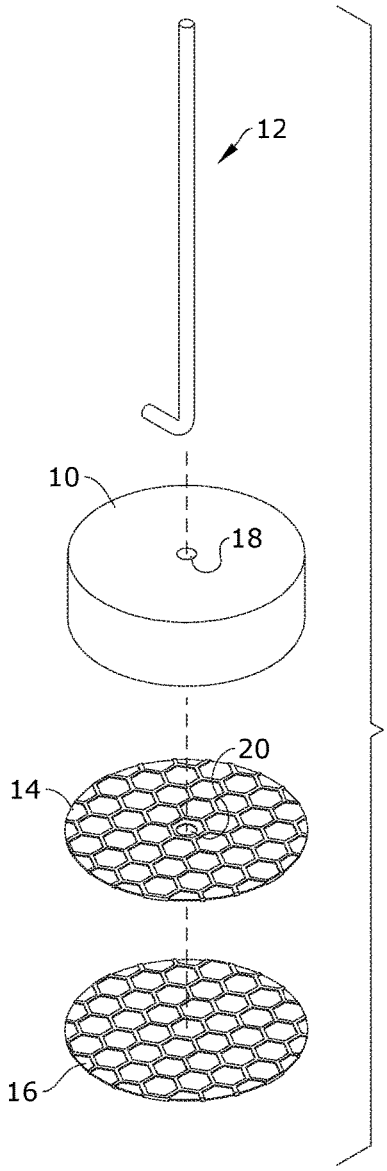
FIG. 2 is a top view of one embodiment of the present disclosure.
Figure 3:
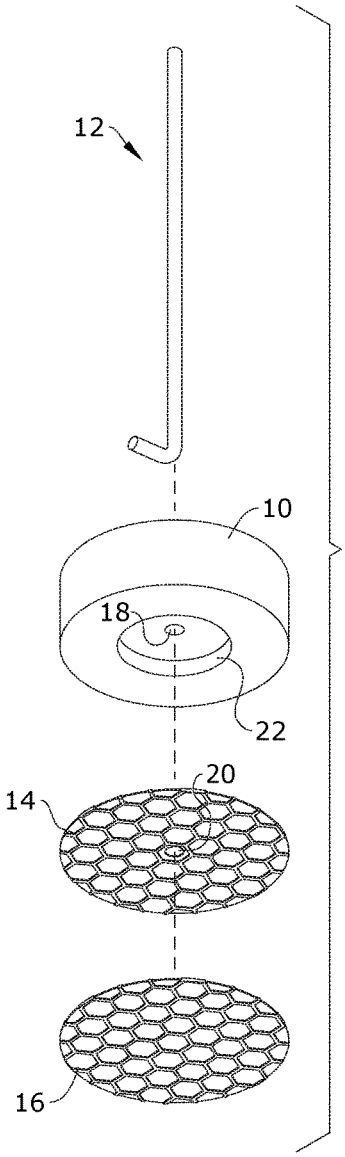
FIG. 3 is a bottom exploded view of one embodiment of the present disclosure.
Figure 4:
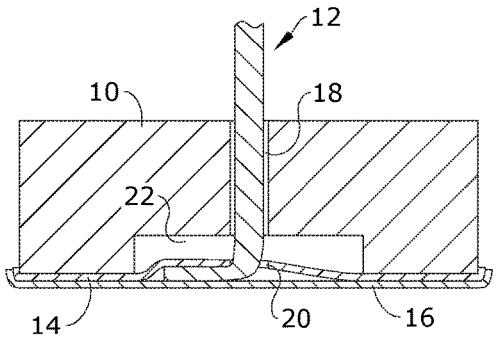
FIG. 4 is a section view of one embodiment of the present disclosure, taken along line 3-3 in FIG. 1.

In alternate embodiments of the wick system of the present disclosure, such as those shown in FIGS. 1-5, the wick system may further comprise a pair of wax discs. A first wax disc 14 may comprise a disc wick orifice 20 extending therethrough, wherein the first wax disc 14 may be positioned adjacent to the bottom surface of the wax base 10 such that the disc wick orifice 20 aligns with the base wick orifice 18, and the wick 12 extends through both the wax base 10 and the first wax disc 14. A second wax disc 16 may be positioned adjacent to a bottom surface of the first wax disc 14, such that an end of the wick 12 is sandwiched between the first wax disc 14 and the second wax disc 16, as shown in FIG. 4.

Figure 5:
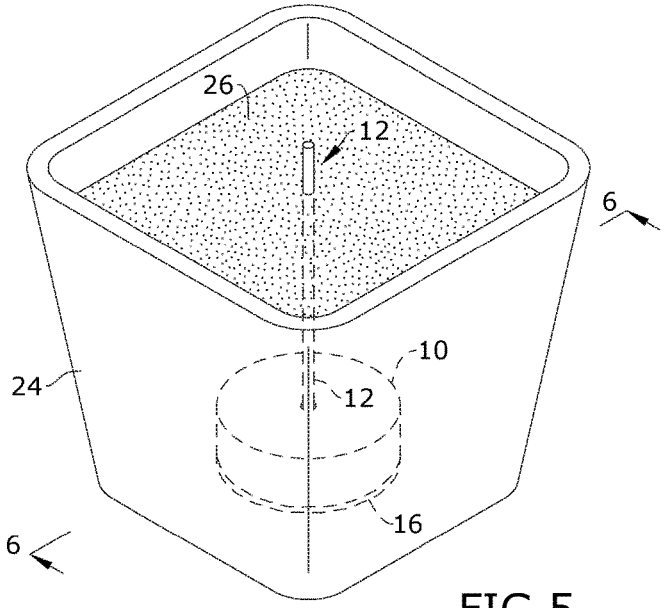
FIG. 5 is a perspective view of one embodiment of the present disclosure, shown in use.
Figure 6:
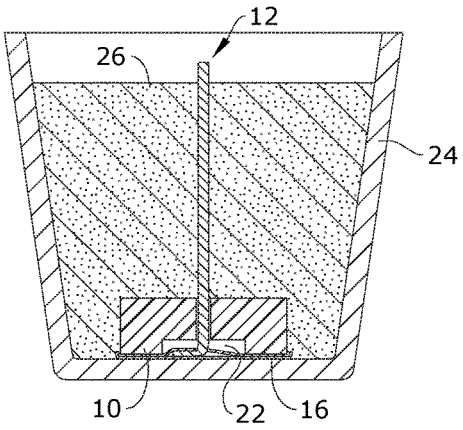
FIG. 6 is a section view of one embodiment of the present disclosure, taken along line 6-6 in FIG. 5.

As shown in FIG. 5, the wax base 10 may be substantially cylindrically shaped and may have a diameter less than a diameter of a container candle in which the wick system is to be used. As described in FIG. 10, to create a candle with the wick system of the present disclosure, a user may thread the wick 12 through the wax base 10 and the first wax disc 14. The first wax disc 14 and the second wax disc 16 may then be formed to the bottom of the wax base 10, ensuring that the end of the wick 12 is sandwiched between the first wax disc 14 and the second wax disc 16 and creating the wick system of the present disclosure. Candle wax 26 may be poured into a candle container 24 without a wick. While the candle wax 26 is still liquid, the wick system may be placed into the candle wax 26, wherein the wax base 10 may be held in place until the candle wax 26 cools. If necessary, the wick 12 may then be cut to the desired length.

Alternatively, a user may place the wick system into the container 24 and pour candle wax 26 around the wick system while holding the wick 12 such that it extends vertically upwards out of the container 24. When the candle wax 26 has solidified, the user may be left with a container candle with a self-extinguishing wick system.

To use the wax system that is positioned within the candle wax 26, the wick 12 may be lit and allowed to burn until it reaches the wax base 10. The wax may continue to melt until the wick is released and falls into the wax pool, extinguishing itself.

Figure 7:
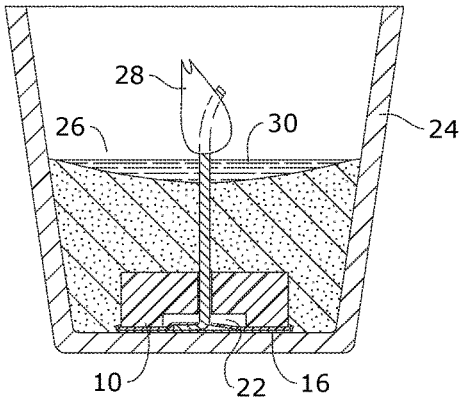
FIG. 7 is a section view of one embodiment of the present disclosure.
Figure 8:
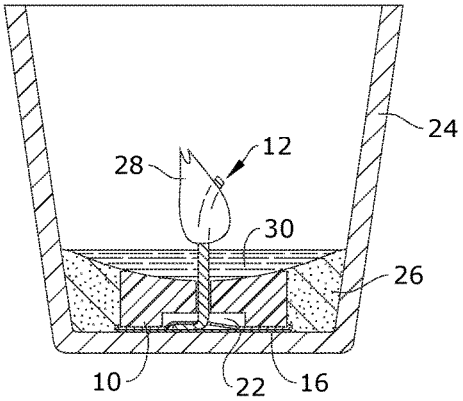
FIG. 8 is a section view of one embodiment of the present disclosure.
Figure 9:
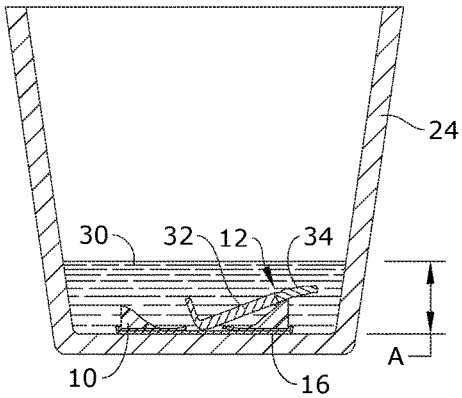
FIG. 9 is a section view of one embodiment of the present disclosure.
Figure 10:
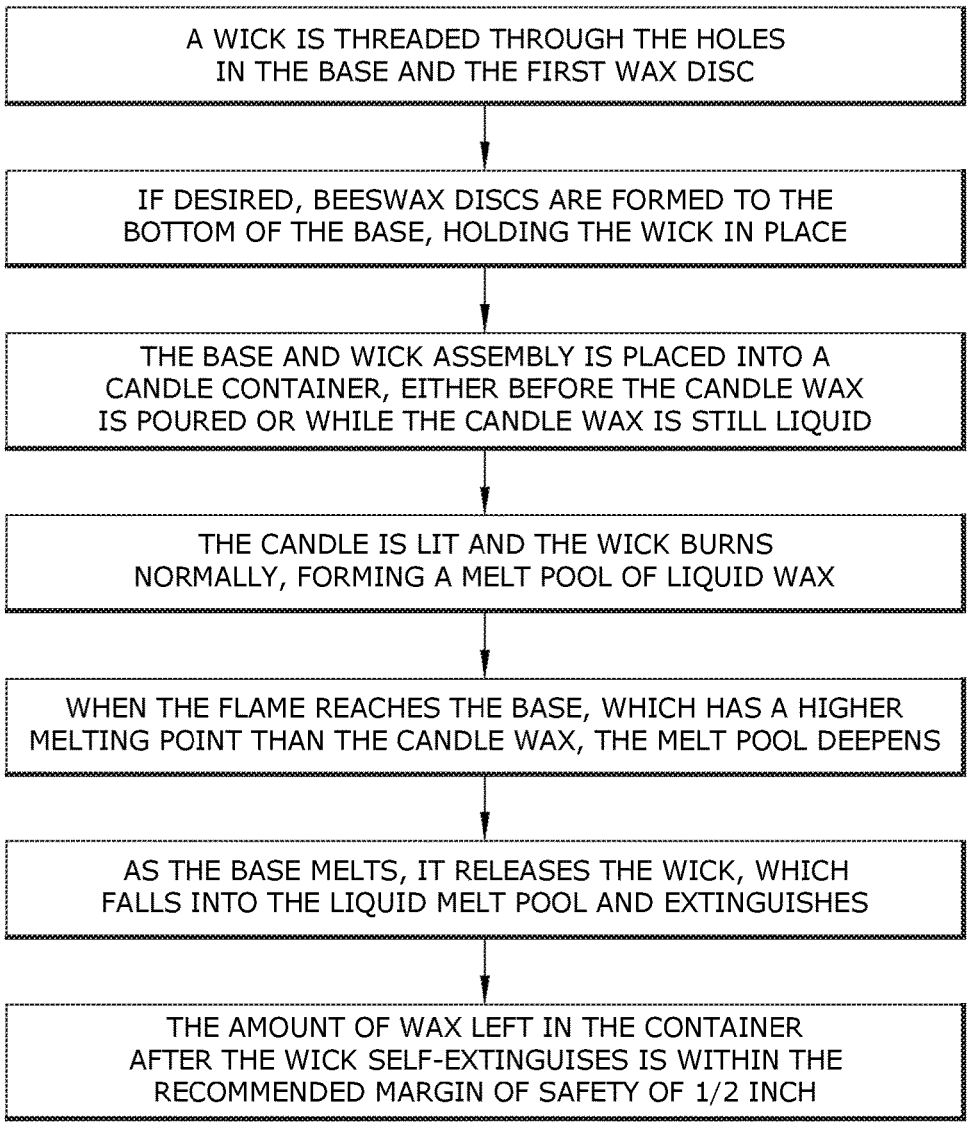
FIG. 10 is a flow chart describing use of one embodiment of the present disclosure.

As described above, the wick system of the present disclosure may be self-extinguishing. For example, as shown in FIGS. 7-9, when the wick 12 burns down, the melt pool 30 gets larger. When the wick 12 has burned down to the wax base 10, the burned part 34 of the wick 12 may fall into the melt pool 30 of the candle, causing the flame 28 to extinguish and, in embodiments, leaving an unburned length 32 of wick 12. As shown in FIG. 9, the depth of the remaining candle wax 26 and melt pool 30 may correspond to, at the least, the National Candle Association recommended height A for extinguishing container candles. This recommendation may be found in the candle safety rules, Bullet 11 on the National Candle Association's website. Additionally, contrary to conventional candles, because the wick system of the present disclosure does not include a metal disk, there is no unsightly metal, sticker, or adhesive shown once the candle has burned own.

The wick system of the present disclosure may be made using any desired materials. In embodiments, the wax used to create the wax base 10 may have a higher melting point than the candle wax 26. As a result, the wax base 10 will not melt with the candle wax 26 is being poured into the container 24 to create the container candle. Moreover, the melting point of the wax discs 14, 16 may be higher than the melting point of the wax base 10. Exemplary materials that may be suitable for the wax base 10 include paraffin, soy, soy blend, and the like. Exemplary material that may be suitable for the wax discs 14, 16 include beeswax and the like. The wick 12 may comprise any desired or known wick material. In a particular embodiment, the wax base 10 may have a melting point of about 130° F.; and the wax discs 14, 16 may have a melting point of from about 144 to about 147° F. A specific embodiment of the wick system comprises a wax base 10 comprising paraffin with a melting point of 130° F. and wax discs 14, 16 comprising beeswax with a melting point of from about 144 to about 147° F. The candle wax 26 used to make the container candle may have a melting point lower than both the wax base 10 and the wax discs 14,16. For example, the candle wax 26 may comprise soy wax having a melting point of from about 111 to about 122° F.

The size and shape of the wax base 10, the wax discs 14, 16, and the wick 12 may vary depending on the design and size of the candle. In a particular embodiment, the wax base 10 may have a thickness of about ¼ inch, while each wax disc 14,16 may have a thickness of about 1/16 inch. The depth of the indentation 22 in the bottom of the wax base 10 may be about 1/16 inch.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A self-extinguishing wick system for a container candle, the wick system comprising:

a wax base having a base wick orifice extending therethrough;

a wick threaded through the base wick orifice and secured to prevent the wick from unintentionally sliding through the base wick orifice;

a first wax disc comprising a disc wick orifice extending therethrough, wherein the first wax disc is positioned adjacent to a bottom surface of the wax base such that the disc wick orifice aligns with the base wick orifice, and the wick extends through both the wax base and the first wax disc; and a second wax disc positioned adjacent to a bottom surface of the first wax disc such that an end of the wick is sandwiched between the first wax disc and the second wax disc, wherein the wax base comprising a wax having a melting point higher than a melting point of a wax used to make the container candle.

2. The self-extinguishing wick system of claim 1, wherein the first wax disc and the second wax disc each have a melting point higher than the melting point of the wax base.

3. The self-extinguishing wick system of claim 2, wherein:

the melting point of the wax base is about 130° F.; and the melting point of each of the first wax disc and the second wax disc is from about 144 to about 147° F.

4. The self-extinguishing wick system of claim 2, wherein:

the wax base comprises paraffin; and each of the first wax disc and the second wax disc comprises beeswax.

5. A container candle with a self-extinguishing wick system, the container candle comprising:

a container;

candle wax held within the container; and a self-extinguishing wick system positioned within the candle wax, the wick system comprising:

a wax base having a base wick orifice extending therethrough;

a wick threaded through the base wick orifice and secured to prevent the wick from unintentionally sliding through the base wick orifice;

a first wax disc comprising a disc wick orifice extending therethrough, wherein the first wax disc is positioned adjacent to a bottom surface of the wax base such that the disc wick orifice aligns with the base wick orifice, and the wick extends through both the wax base and the first wax disc; and a second wax disc positioned adjacent to a bottom surface of the first wax disc such that an end of the wick is sandwiched between the first wax disc and the second wax disc, wherein the wax base comprising a wax having a melting point higher than a melting point of the candle wax.

6. The container candle of claim 5, wherein the first wax disc and the second wax disc each have a melting point higher than the melting point of the wax base.

7. The self-extinguishing wick system of claim 6, wherein:

the melting point of the wax base is about 130° F.;

the melting point of each of the first wax disc and the second wax disc is from about 144 to about 147° F.; and the melting point of the candle wax is from about 111 to about 122° F.

8. The self-extinguishing wick system of claim 6, wherein:

the wax base comprises paraffin;

each of the first wax disc and the second wax disc comprises beeswax; and the candle wax comprises soy.

* * * * *